US010760304B2

(12) United States Patent
Do

(10) Patent No.: US 10,760,304 B2
(45) Date of Patent: Sep. 1, 2020

(54) ADJUSTABLE HOOK LATCH

(71) Applicant: Arconic Inc., Pittsburgh, PA (US)

(72) Inventor: Thai Do, Laguna Niguel, CA (US)

(73) Assignee: Howmet Aerospace Inc., Pittsburgh, PA (US)

( * ) Notice: Subject to any disclaimer, the term of this patent is extended or adjusted under 35 U.S.C. 154(b) by 955 days.

(21) Appl. No.: 15/251,535

(22) Filed: Aug. 30, 2016

(65) Prior Publication Data

US 2017/0058568 A1 Mar. 2, 2017

Related U.S. Application Data

(60) Provisional application No. 62/212,669, filed on Sep. 1, 2015.

(51) Int. Cl.

| | |
|---|---|
| ***E05B 63/06*** | (2006.01) |
| ***E05C 19/10*** | (2006.01) |
| ***E05C 19/14*** | (2006.01) |

(52) U.S. Cl.

CPC ..... *E05B 63/06* (2013.01); *E05C 19/10* (2013.01); *E05C 19/145* (2013.01)

(58) Field of Classification Search

CPC ..... E05B 63/06; E05B 5/00; E05B 15/006; E05B 63/0056; E05B 15/025; E05B 41/00; E05B 2015/0235; E05B 15/0086; E05C 19/10; E05C 19/145; E05C 19/14; Y10S 292/31; Y10S 292/60; Y10S 292/49;

(Continued)

(56) References Cited

U.S. PATENT DOCUMENTS 491,908 A * 2/1893 Starz ..... F16B 39/24 411/143
1,119,321 A * 12/1914 Schmidgall ..... E05B 15/0245 292/341.18

(Continued)

FOREIGN PATENT DOCUMENTS

CN 102191876 A 9/2011
CN 202926055 U 5/2013

(Continued)

OTHER PUBLICATIONS

International Search Report and Written Opinion dated Nov. 23, 2016, issued by the European Patent Office in International (PCT) Application No. PCT/US2016/049434 filed Aug. 30, 2016 (10 pages).

(Continued)

*Primary Examiner* — Christine M Mills
(74) *Attorney, Agent, or Firm* — Greenberg Traurig, LLP

(57) ABSTRACT

A latch including a housing having a cylinder, a compression spring positioned within the cylinder, and a ball positioned at one end of the compression spring, a hook positioned slidably within the housing, and a star wheel positioned around the hook and having a plurality of holes formed therein. The ball under load from the spring aligns with and engages one of the holes of the star wheel to retain it in place. The star wheel is moveable rotatably such that the ball disengages the one of the holes of the star wheel to enable the hook to move axially and be adjusted relative to the housing, and the ball is adapted to engage another of the holes of the star wheel to retain the star wheel and prevent inadvertent rotation.

8 Claims, 3 Drawing Sheets

(58) Field of Classification Search

CPC ..... Y10T 292/06; Y10T 292/0945; Y10T 292/0863; Y10T 292/0877; Y10T 292/0886; Y10T 292/089; Y10T 292/0911; Y10T 292/0913; Y10T 292/0917; Y10T 292/0914; Y10T 292/092; Y10T 292/0949; Y10T 292/14; Y10T 292/705; Y10T 292/1094; Y10T 292/1099; B64D 29/06

USPC .... 292/1.5, 96, 57, 71, 63, 66, 95, 109, 113, 292/110, 115, 100, DIG. 31, DIG. 60, 292/212, 251, 341.18, DIG. 49

See application file for complete search history.

(56) References Cited

U.S. PATENT DOCUMENTS 1,206,342 A 11/1916 Linborg
2,712,955 A 7/1955 Andrews
2,726,889 A 12/1955 Lawson
2,904,141 A * 9/1959 Henrichs ..... B64D 29/06 403/321
2,927,812 A 3/1960 Smith et al.
2,944,848 A 7/1960 Mandolf
3,070,395 A 12/1962 Morrison et al.
3,212,746 A * 10/1965 Wright ..... F16B 2/12 410/77
3,259,411 A 7/1966 Griffiths
3,259,412 A 7/1966 Wheeler
3,341,239 A 9/1967 Wheeler
3,347,578 A 10/1967 Sheehan et al.
3,473,693 A 10/1969 Fritz
3,664,696 A * 5/1972 Poe ..... E05C 19/145 292/66
3,917,327 A 11/1975 Plasko
4,053,177 A 10/1977 Stammreich et al.
4,099,751 A 7/1978 Poe et al.
4,116,479 A 9/1978 Poe
4,130,307 A 12/1978 Poe et al.
4,183,564 A * 1/1980 Poe ..... E05B 15/025 292/113
4,220,364 A 9/1980 Poe
4,361,057 A * 11/1982 Kochera ..... B62K 21/16 74/551.4
4,421,349 A * 12/1983 Greiert, Jr. ..... B64D 29/06 292/113
4,478,446 A * 10/1984 Duran ..... E05B 15/025 292/113
RE31,935 E * 7/1985 Poe ..... E05B 15/025 292/113
4,530,529 A * 7/1985 Poe ..... E05B 15/025 292/113
4,538,843 A * 9/1985 Harris ..... B64D 29/06 292/113
4,602,812 A 7/1986 Bourne
4,641,868 A 2/1987 Miron
4,691,952 A * 9/1987 Harmon ..... E05B 15/025 292/113
4,798,408 A * 1/1989 Harmon ..... E05B 15/025 292/341.18
4,826,221 A 5/1989 Harmon
4,828,299 A 5/1989 Poe
4,852,923 A * 8/1989 Harmon ..... E05B 15/025 292/341.18
4,858,970 A 8/1989 Tedesco et al.
4,906,037 A * 3/1990 Stammreich ..... F16B 31/02 292/341.18
4,911,488 A 3/1990 Brackmann et al.
5,016,931 A * 5/1991 Jackson ..... E05B 15/025 292/341.18
5,152,926 A 10/1992 Brown
5,177,988 A * 1/1993 Bushnell ..... E05B 47/0002 292/144
5,228,730 A 7/1993 Gokcebay et al.
5,341,752 A 8/1994 Hambleton
5,609,373 A 3/1997 Gromotka
5,620,212 A * 4/1997 Bourne ..... B64D 29/06 292/113
5,660,295 A 8/1997 Hroma et al.
5,664,813 A 9/1997 Gromotka
5,765,883 A * 6/1998 Dessenberger ..... B64D 29/06 292/92
5,984,382 A * 11/1999 Bourne ..... B64D 29/06 292/113
6,123,370 A 9/2000 Rozema et al.
6,343,815 B1 2/2002 Poe
6,361,090 B1 3/2002 Fan
6,382,690 B1 * 5/2002 Dessenberger, Jr. ... E05B 41/00 292/113
6,513,841 B1 * 2/2003 Jackson ..... B64D 29/06 292/126
6,755,448 B2 * 6/2004 Jackson ..... B64D 29/06 244/110 B
6,866,226 B2 * 3/2005 Pratt ..... B64C 1/1469 244/129.4
6,913,297 B2 7/2005 Jackson et al.
7,029,038 B2 4/2006 Kobrehel
7,156,429 B2 1/2007 Eriksson
7,504,601 B2 3/2009 Belmond et al.
7,857,362 B2 12/2010 Deblock
8,016,327 B2 * 9/2011 Dinh ..... E05C 1/06 292/1
8,113,551 B2 * 2/2012 Baic ..... E05B 15/0006 292/109
8,479,543 B2 7/2013 Yang et al.
8,646,819 B2 2/2014 Do et al.
8,727,390 B2 5/2014 Do
8,864,185 B2 * 10/2014 Do ..... B64C 1/1446 292/105
8,864,189 B2 * 10/2014 Fournie ..... E05C 19/145 292/256.69
8,925,979 B2 * 1/2015 Hernandez ..... E05B 63/143 292/113
9,273,488 B1 * 3/2016 Yu ..... E05B 15/025
9,353,559 B2 * 5/2016 Fabre ..... E05C 19/145
9,567,784 B2 * 2/2017 Defrance ..... E05C 19/145
9,677,306 B2 * 6/2017 DeFrance ..... E05C 19/10
10,173,782 B2 * 1/2019 Hernandez ..... B64D 29/06
10,240,389 B2 * 3/2019 Do ..... B64C 1/1461
10,309,126 B2 * 6/2019 Do ..... B64C 1/1407
10,443,279 B2 * 10/2019 Kim ..... E05B 13/002
2002/0000726 A1 1/2002 Zintler
2002/0060459 A1 5/2002 Zintler
2005/0087996 A1 4/2005 Jackson et al.
2006/0214431 A1 9/2006 Helsley et al.
2008/0129056 A1 6/2008 Hernandez et al.
2011/0109103 A1 5/2011 Huston et al.
2011/0227350 A1 9/2011 Do
2012/0102842 A1 5/2012 Fournie et al.
2012/0151724 A1 6/2012 DeFrance et al.
2012/0242096 A1 * 9/2012 Rozema ..... E05B 5/00 292/202
2013/0328326 A1 12/2013 DeFrance
2015/0184543 A1 7/2015 Fabre et al.
2015/0184544 A1 7/2015 Fabre et al.

FOREIGN PATENT DOCUMENTS

CN 206053629 U 3/2017
DE 202220 C 9/1908
DE 29807738 U1 7/1998
EP 1091059 A2 4/2001
EP 2031157 A1 3/2009
EP 2444575 A1 4/2012
EP 2674362 A1 12/2013
FR 2397503 A1 2/1979
FR 2852049 A1 9/2004
GB 191493 A 1/1923
GB 1497982 A 1/1978
GB 1537410 A 12/1978
WO 2010033026 A1 3/2010
WO 2010149905 A1 12/2010

(56) References Cited

FOREIGN PATENT DOCUMENTS

OTHER PUBLICATIONS

Aerospace Latching Systems, Alcoa Fastening Systems, http://www.alcoa.com/fastening_systems/aerospace/en/product.asp?cat_id=213&prod_id=500,pp. I1-I2, 159-160, and i-iii (8 pages).
Fairchild Fasteners, Aerospace Mechanisms, "RAM™ Aerospace Latch Mechanism", 2000 (4 pages).
Rotary Latch #TL18261, Alcoa Fastening Systems, Mar. 2005 (1 page).
English-language translation of WO 2010/149905 A1 (8 pages).
International Search Report and Written Opinion dated Jul. 20, 2012, issued by the European Patent Office in connection with International Patent Application No. PCT/US2012/028418 entitled "Pin Latch Having Intermediate Position" (13 pages).
International Search Report and Written Opinion dated Jan. 18, 2013, issued by the European Patent Office in connection with International Patent Application No. PCT/US2012/059206 entitled "Rotary-Handle Latch" (9 pages).
International Search Report and Written Opinion dated Feb. 25, 2013, issued by the European Patent Office in connection with International Patent Application No. PCT/US2012/066039 entitled "Pin Latch With Detection Device and Movable Catch-Pin and Intermediate Position With Automatic Return Mechanism" (15 pages).
International Search Report and Written Opinion dated Dec. 29, 2011, issued by the European Patent Office in connection with International Patent Application No. PCT/US2011/027871 entitled "Latch With Adjustable Handle" (17 pages).
International Search Report and Written Opinion dated Jul. 15, 2011, issued by the European Patent Office in connection with International Patent Application No. PCT/US2011/027671 entitled "Latch With Adjustable Handle" (8 pages).
International Search Report and Written Opinion dated Jun. 7, 2011, issued by the European Patent Office in connection with International Patent Application No. PCT/US2011/024031 entitled "Side-Driven Action Pin Latch" (9 pages).
International Search Report and Written Opinion dated Jun. 9, 2016, issued by the European Patent Office in connection with International Patent Application No. PCT/US2016/024836 (13 pages).
Alcoa Fastening Systems, Document TL22028 Rev. P, dated Jun. 18, 2015 (2 pages).
Alcoa Camloc/RAM Catalog, pp. I-13 to I-17 (3 pages).

* cited by examiner

ADJUSTABLE HOOK LATCH

CROSS-REFERENCE TO RELATED APPLICATION

This application relates to and claims the benefit of commonly-owned, U.S. Provisional Patent Application Ser. No. 62/212,669, filed Sep. 1, 2015, entitled "ADJUSTABLE HOOK LATCH," the entirety of which is incorporated herein by reference.

FIELD OF THE INVENTION

The present invention relates to latches and, more particularly, adjustable hook latches.

SUMMARY OF THE INVENTION

The technical problem to be solved by the present invention is to provide an adjustable latch that offers a constant torque for adjusting the distance between two mounting points.

In an embodiment, a latch including a housing having a first end, a second end opposite the first end, a first chamber that extends from the first end to a location intermediate the first and second ends, a second chamber that extends from the first end to a location intermediate the first and second ends; a cylinder positioned within the first chamber, wherein the cylinder includes a body having a hollow portion, a compression spring positioned within the hollow portion of the body, and a ball positioned at one end of the compression spring proximate to the first end of the housing; a hook positioned slidably within the second chamber of the housing and including a shaft and a hook head at one end of the shaft; a star wheel positioned around the shaft of the hook and further positioned at the first end of the housing, wherein the star wheel includes a shaft and a flange located at one end of the shaft and having a face juxtaposed with the first end of the housing and a first plurality of holes formed within the face, wherein the ball aligns with and engages one of the first plurality of holes of the star wheel to retain the star wheel in a first position, wherein the star wheel is moveable rotatably relative to the housing, such that when the star wheel is rotated, the ball disengages the one of the first plurality of holes of the star wheel to enable the hook to move axially relative to the housing, and wherein, when the star wheel is rotated, the ball is adapted to engage another of the first plurality of holes of the star wheel to retain the star wheel in a second position; and a handle attached pivotally to the housing.

In an embodiment, the handle is attached to the housing by a pivot pin. In an embodiment, a mounting distance of the hook measured from a center of the pivot pin to a center point of the head of the hook is adjusted when the star wheel is rotated. In an embodiment, the cylinder includes a flange formed at one end of the body and having an opening, and the star wheel includes an annular portion, wherein a portion of the flange of the cylinder is positioned between the annular portion of the star wheel and the flange of the star wheel, and wherein the portion of the flange of the cylinder is positioned against a face of the annular portion of the star wheel, and wherein the ball protrudes through the opening of the flange of the cylinder. In an embodiment, the first plurality of holes of the star wheel is formed in a circular pattern. In an embodiment, the star wheel includes a circumferential edge and second plurality of holes formed within the circumferential edge, each of the second plurality of holes being adapted to receive an external tool for rotating the star wheel relative to the housing In an embodiment, the handle is moveable between a closed position, in which the handle is attached releasably to the housing, and an open position, in which the handle is detached from the housing. In an embodiment, the housing includes a catch pin, and wherein the handle includes a trigger that is releasably engageable with the catch pin of the housing when the handle is in its closed position. In an embodiment, the handle includes a pair of opposing side members, each of which includes a slot formed therein, a pair of links, each having a first end and a second end opposite the first end of the link, and a bushing interconnecting the first ends of the links to one another, and wherein the second ends of the links are attached to the pivot pin, and wherein one end of the bushing extends through one of the slots and the other end of the bushing extends through the other one of the slots. In an embodiment, the hook is retracted when the handle is moved from its open position to its closed position.

In an embodiment, a latch including a housing having a first end, a second end opposite the first end, a first chamber that extends from the first end to a location intermediate the first and second ends, a second chamber that extends from the first end to a location intermediate the first and second ends; a cylinder positioned within the first chamber, wherein the cylinder includes a body having a hollow portion, a compression spring positioned within the hollow portion of the body, and a ball positioned at one end of the compression spring proximate to the first end of the housing; a hook positioned slidably within the second chamber of the housing and including a shaft and a hook head at one end of the shaft; and a star wheel positioned around the shaft of the hook and at the first end of the housing, wherein the star wheel includes a shaft and a flange located at one end of the shaft and having a face juxtaposed with the first end of the housing and a first plurality of holes formed within the face, wherein the ball aligns with and engages one of the first plurality of holes of the star wheel to retain the star wheel in a first position, wherein the star wheel is rotatably moveable relative to the housing, such that when the star wheel is rotated, the ball disengages the one of the first plurality of holes of the star wheel to enable the star wheel and the hook to move axially relative to the housing, and wherein the ball is adapted to engage another of the first plurality of holes of the star wheel to retain the star wheel in a second position.

In an embodiment, an adjustable hook latch having an anti-rotation feature that offers a constant torque for adjusting the distance between two mounting points. In an embodiment, the anti-rotation feature is self-enclosed so as to prevent damage thereto. In an embodiment, the hook latch is adapted for use in the aerospace field, such as aerospace doors, nacelles, etc. In other embodiments, the latch can be used in other fields and applications.

The latch of the present invention is advantageous over prior art latches in that it includes an adjustment feature, namely, a star wheel that is moveable rotatably such that the ball disengages one of the holes of the star wheel to enable the hook to move axially and be adjusted relative to the housing, while providing constant torque. The ball is adapted to engage another of the holes of the star wheel to retain the star wheel in place and prevent inadvertent rotation thereof.

DETAILED DESCRIPTION OF THE DRAWINGS

Figure 1:
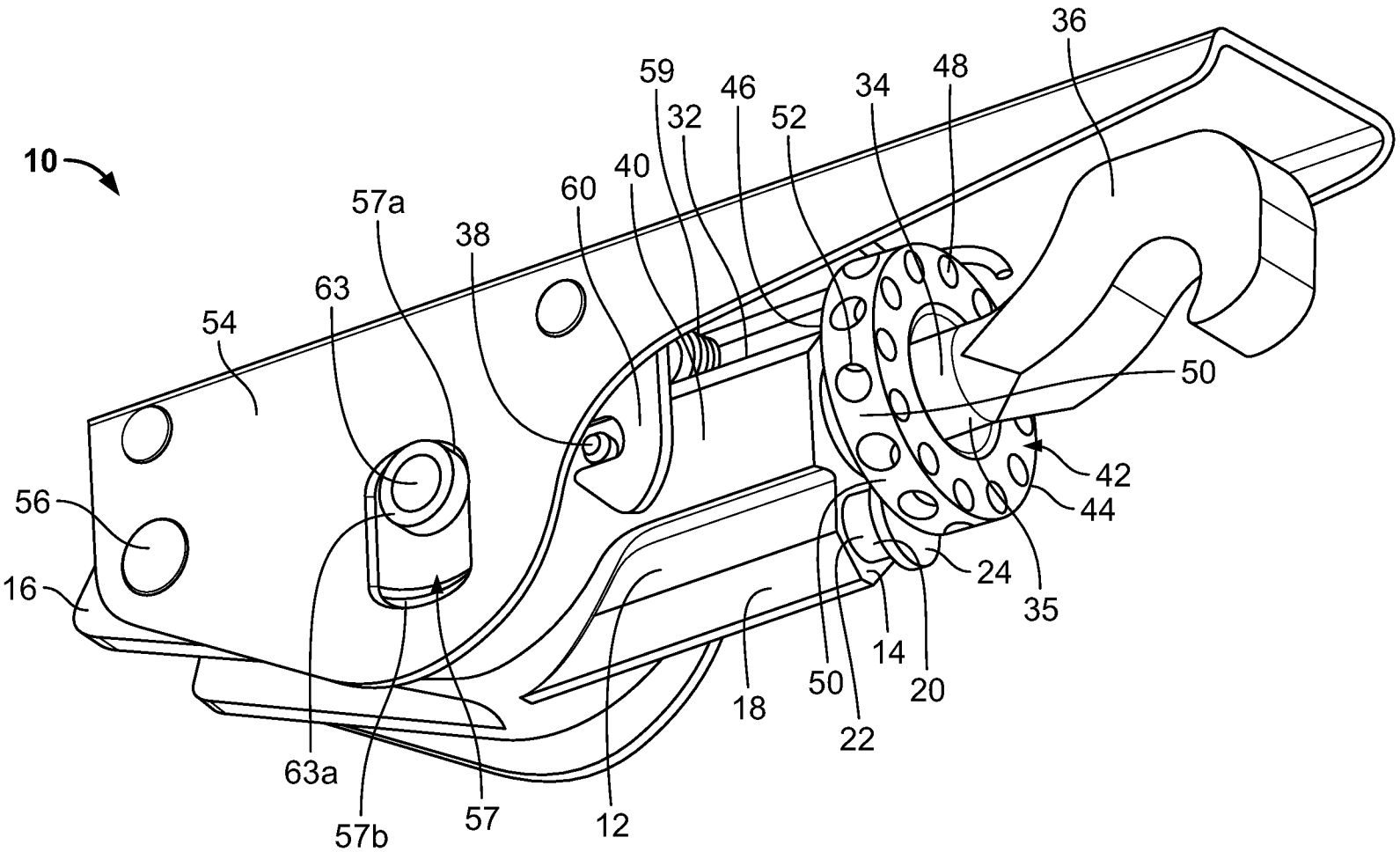
FIG. 1 is a bottom perspective view of an adjustable hook latch in accordance with an embodiment, the hook latch being shown in a closed position.
Figure 2:
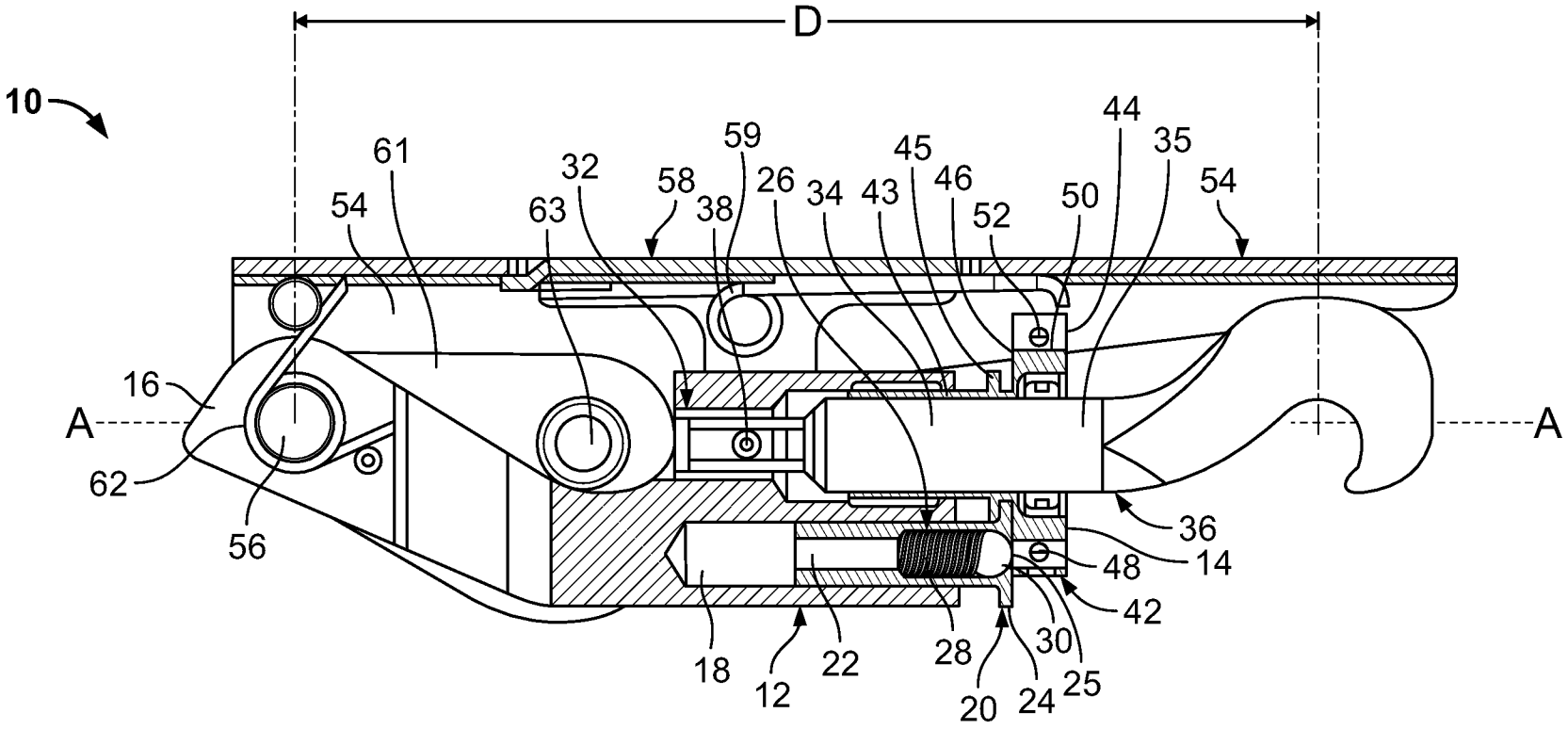
FIG. 2 is a side cross-sectional view of the hook latch shown in FIG. 1.

Referring to FIGS. 1 and 2, in an embodiment, a hook latch 10 having a housing 12 with a first end 14 and a second end 16 opposite the first end 14. In an embodiment, the housing 12 includes a first chamber 18 that extends from the first end 14 to a location intermediate the first and second ends 14, 16 of the housing 12. In an embodiment, the first chamber 18 is sized and shaped to receive slidably a cylinder 20. In an embodiment, the cylinder 20 includes an elongated body 22 and a flange 24 located at one end of the body 22. In an embodiment, the flange 24 is circular in shape. In an embodiment, the flange 24 includes a circular-shaped, centralized opening 25 formed therein. In an embodiment, the body 22 of the cylinder 20 includes a hollow portion 26 that is sized and shaped to receive a compression spring 28 and a ball 30 positioned at one end of the compression spring 28 and proximate to the first end 14 of the housing 12. In an embodiment, the opening 25 of the flange 24 is in communication with the hollow portion 26 of the cylinder 20. In an embodiment, the compression spring 28 and the ball 30 nest in the hollow portion 26 of the cylinder 20 which is guided by the first chamber 18. In an embodiment, a surface of the ball 30 protrudes through the opening 25 of the flange 24 of the body 22.

Still referring to FIGS. 1 and 2, in an embodiment, the housing 12 includes a second chamber 32 that extends from the first end 14 to a point intermediate the first and second ends 14, 16. In an embodiment, the second chamber 32 is positioned above the first chamber 18 relative to a longitudinal axis A-A of the housing 12, as oriented and shown in the Figures. In an embodiment, the second chamber 32 is sized and shaped to receive a hook 34 having a shaft 35 and a hook head 36 formed on an end of the shaft 35. In an embodiment, the second chamber 32 is sized and shaped to receive slidably the shaft 35 of the hook 34. In an embodiment, a catch pin 38 extends through one end of the shaft 35 of the hook 34 transversely to the longitudinal axis A-A of the housing 12 and protrudes outwardly from the housing 12 at opposite side portions 40 thereof (only one side portion 40 shown in FIG. 1).

In an embodiment, a star wheel 42 is positioned on the shaft 35 of the hook 34 and juxtaposed with the first end 14 of the housing 12. In an embodiment, the star wheel 42 includes a hollow, elongated shaft 43 which is sized and shaped to receive the shaft 35 of the hook 34, a flange 44 located at one end of the shaft 35, and an annular portion 45 extending outwardly from the shaft 35 and located proximate to the flange 44. In an embodiment, a portion of the flange 24 of the cylinder 20 is positioned between the annular portion 45 and the flange 44 of the star wheel 42. In an embodiment, the flange 44 of the star wheel 42 includes a face 46 with a first plurality of holes 48 that are each sized and shaped to receive the portion of the ball 30 exposed through the flange 24 of the cylinder 20, and a circumferential edge 50 having a second plurality of holes 52 that are each sized and shaped to receive an adjusting tool. In an embodiment, the holes of the first plurality of holes 48 are spaced apart from one another and form a circular pattern. In an embodiment, the star wheel 42 is adjustable rotatably either clockwise or counterclockwise relative to the longitudinal axis A-A of the housing 12. In an embodiment, a portion of the flange 24 of the cylinder 20 is positioned and trapped between the flange 44 of the star wheel 42 and the annular portion 45 of the star wheel 42 and against a face of the annular portion 45 of the star wheel 42 while under the load of the compression spring 28, while the ball 30 aligns with and engages one of the first plurality of holes 48 of the star wheel 42. In this regard, pressure from the compression spring 28 on the ball 30 prevents the star wheel 42 from rotating relative to the longitudinal axis A-A.

Figure 3:
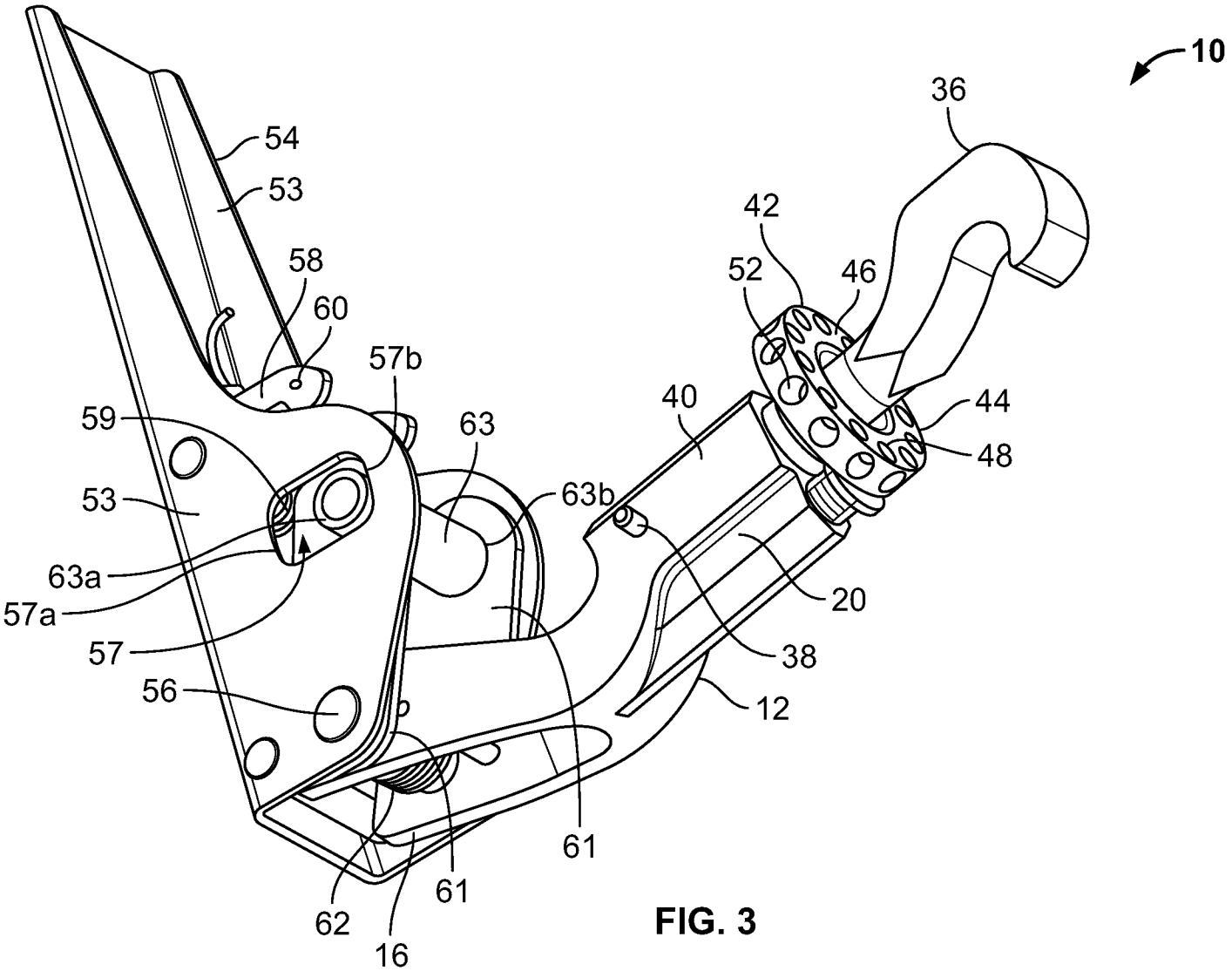
FIG. 3 is a bottom perspective view of the hook latch shown in FIG. 1, but shown in an open position.

Referring to FIGS. 1 through 3, in an embodiment, the hook latch 10 includes a handle 54 attached rotatably to the second end 16 of the housing 12 by a pivot pin 56 extending through the second end 16 of the housing 12 and is moveable from a closed position to an open position, and vice-versa. In an embodiment, the handle 54 includes a trigger 58 having detents 60 that engage the catch pin 38 when the handle 54 is in its closed position. In an embodiment, the trigger 58 includes a trigger spring 59. In an embodiment, the handle 54 includes a pair of opposing side members 53, each of which includes a slot 57 formed therethrough. In an embodiment, each of the slots 57 is rounded rectangular-shaped and includes a first end 57*a* and a second end 57*b* opposite the first end 57*a*. In an embodiment, each of the slots 57 can be rectangular in shape or consist of any other suitable shape. In an embodiment, the handle 54 includes a pair of links 61 and a cylindrical-shaped bushing 63 interconnecting one end of each of the links 61 to one another. In an embodiment, one end 63*a* of the bushing 63 extends through one of the slots 57 and the other end 63*b* of the bushing 63 extends through the other one of the slots 57. In an embodiment, opposite ends of the links 61 are connected rotatably to the pivot pin 56. When the handle 54 is in its closed position, the ends 63*a*, 63*b* of the bushing 63 are positioned proximate to the ends 57*a* of the slots 57.

In an embodiment, when the trigger 58 is depressed, the detents 60 disengage the catch pin 38 to enable the handle 54 to move from the closed position to the open position, and, thus, retract the hook 34 from a first position to a second position. In this regard, when the handle 54 is moved from its closed position to its open position, the slots 57 move over the ends 63*a*, 63*b* of the bushing until the ends 63*a*, 63*b* engage the ends 57*b* of the slots 57 in order to rotate the links 61, which, in turn, retract the hook 34. In an embodiment, a back spring 62 surrounds the pivot pin 56 in order to maintain the handle 54 in its open position.

Referring to FIG. 2, the mounting distance D of the hook 34 along the longitudinal axis A-A (i.e., measured from the center of the pivot pin 56 to a center point of the hook head 36) can be adjusted by turning the star wheel 42 with a standard tool, which engages one or more of the second plurality of holes 52. In this regard, turning the star wheel 42 moves the star wheel 42 in a longitudinal direction along axis A-A and drives the cylinder 20 along with it, while the ball 30 disengages one of the first plurality of holes 48 of the star wheel 42 and then engages another (e.g., the next adjacent one) of the first plurality of holes 48 under constant spring load from the compression spring 28.

It should be understood that the embodiments described herein are merely exemplary and that a person skilled in the art may make many variations and modifications without departing from the spirit and scope of the invention. All such variations and modifications are intended to be included within the scope of the claims.

What is claimed is:

1. A latch, comprising:

a housing having a first end, a second end opposite the first end, a first chamber that extends from the first end to a location intermediate the first end and the second end, a second chamber that extends from the first end to a location intermediate the first end and the second ends;

a cylinder positioned within the first chamber, wherein the cylinder includes a body having a hollow portion, a compression spring positioned within the hollow portion of the body, a ball positioned at one end of the compression spring proximate to the first end of the housing, and a flange formed at one end of the body and having an opening;

a hook positioned slidably within the second chamber of the housing and including a shaft and a hook head at one end of the shaft;

a star wheel positioned around the shaft of the hook and further positioned at the first end of the housing, wherein the star wheel includes a shaft, a flange located at one end of the shaft and having a face juxtaposed with the first end of the housing, an annular portion, and a first plurality of holes formed within the face, wherein the ball aligns with and engages one of the first plurality of holes of the star wheel to retain the star wheel in a first position, wherein the star wheel is moveable rotatably relative to the housing, such that when the star wheel is rotated, the ball disengages the one of the first plurality of holes of the star wheel to enable the hook to move axially relative to the housing, and wherein, when the star wheel is rotated, the ball is adapted to engage another of the first plurality of holes of the star wheel to retain the star wheel in a second position, wherein a portion of the flange of the cylinder is positioned between the annular portion of the star wheel and the flange of the star wheel, wherein the portion of the flange of the cylinder is positioned against the face of the annular portion of the star wheel, and wherein the ball protrudes through the opening of the flange of the cylinder;

and a handle attached pivotally to the housing by a pivot pin, wherein a mounting distance of the hook measured from a center of the pivot pin to a center point of the head of the hook is adapted to be adjusted when the star wheel is rotated.

2. The latch of claim 1, wherein the first plurality of holes of the star wheel are formed in a circular pattern.

3. The latch of claim 1, wherein the star wheel includes a circumferential edge and second plurality of holes formed within the circumferential edge, each of the second plurality of holes being adapted to receive an external tool for rotating the star wheel relative to the housing.

4. The latch of claim 3, wherein the handle is moveable between a closed position, in which the handle is attached releasably to the housing, and an open position, in which the handle is detached from the housing.

5. The latch of claim 4, wherein the housing includes a catch pin, and wherein the handle includes a trigger that is releasably engageable with the catch pin of the housing when the handle is in its closed position.

6. The latch of claim 5, wherein the handle includes a pair of opposing side members, each of which includes a slot formed therein, a pair of links, each having a first end and a second end opposite the first end of the link, and a bushing interconnecting the first ends of the links to one another, and wherein the second ends of the links are attached to the pivot pin, and wherein one end of the bushing extends through one of the slots and the other end of the bushing extends through the other one of the slots.

7. The latch of claim 6, wherein the hook is retracted when the handle is moved from its closed position to its open position.

8. A latch, comprising:

a housing having a first end, a second end opposite the first end, a first chamber that extends from the first end to a location intermediate the first end and the second ends, a second chamber that extends from the first end to a location intermediate the first end and the second ends;

a cylinder positioned within the first chamber, wherein the cylinder includes a body having a hollow portion, a compression spring positioned within the hollow portion of the body, and a ball positioned at one end of the compression spring proximate to the first end of the housing, and a flange formed at one end of the body and having an opening;

a hook positioned slidably within the second chamber of the housing and including a shaft and a hook head at one end of the shaft; and a star wheel positioned around the shaft of the hook and at the first end of the housing, wherein the star wheel includes a shaft and a flange located at one end of the shaft and having a face juxtaposed with the first end of the housing, an annular portion, and a first plurality of holes formed within the face, wherein the ball aligns with and engages one of the first plurality of holes of the star wheel to retain the star wheel in a first position, wherein the star wheel is rotatably moveable relative to the housing, such that when the star wheel is rotated, the ball disengages the one of the first plurality of holes of the star wheel to enable the hook to move axially relative to the housing, and wherein the ball is adapted to engage another of the first plurality of holes of the star wheel to retain the star wheel in a second position, wherein a portion of the flange of the cylinder is positioned between the annular portion of the star wheel and the flange of the star wheel, wherein the portion of the flange of the cylinder is positioned against the face of the annular portion of the star wheel, and wherein the ball protrudes through the opening of the flange of the cylinder.

* * * * *